US006059542A

United States Patent [19]

Chou

[11] Patent Number: 6,059,542

[45] Date of Patent: May 9, 2000

[54] STRUCTURE OF AN AIR COMPRESSOR

[76] Inventor: Wen San Chou, P.O. Box 82-144, Taipei, Taiwan

[21] Appl. No.: 09/178,412

[22] Filed: Oct. 26, 1998

[51] Int. Cl.[7] ..... F04B 17/03

[52] U.S. Cl. ..... 417/360; 417/415; 417/442

[58] Field of Search ..... 417/360, 415, 417/442

[56] References Cited

U.S. PATENT DOCUMENTS 5,215,447 6/1993 Wen ..... 417/415

5,655,887 8/1997 Chou ..... 417/415

*Primary Examiner*—Andrew M. Dolinar

*Attorney, Agent, or Firm*—A & J

[57] ABSTRACT

An air compressor includes a one-piece injection molded main frame including a vertical portion formed with two horizontal holes, an upper opening between the two horizontal holes and a lower circular opening below the upper circular opening, two screws extending through the two horizontal holes to fixedly mount an electric motor on the vertical portion of said main frame, a shaft rotatably fitted in a lower circular opening and kept in place by a retainer ring, a driven gear fixedly mounted on the shaft and meshed with the driving gear, a flywheel formed with an eccentric projection fixedly mounted on the shaft and located adjacent to the driven gear, an upper part of the vertical portion being formed with a cylinder in which is fitted a piston, a first and second outlet pipes formed on the top of the cylinder, and a cover engageable with a center hole of the cap and the nozzle, whereby the piston can move smoothly within the cylinder and the two outlet pipes can be adapted for use with different nozzles.

2 Claims, 7 Drawing Sheets

STRUCTURE OF AN AIR COMPRESSOR

BACKGROUND OF THE INVENTION

1. Field of the Invention

This invention is related to an improved structure of an air compressor.

2. Description of the Prior Art

With reference to FIG. 10, the conventional air compressor includes an inverted L-shaped main frame 90 which is formed with a circular opening 901 at the horizontal portion for mounting a cylinder 91. The vertical portion of the main frame 90 is formed with an upper circular hole 902 for the passage of the front end of an electric motor 92 and a lower circular hole 903 for the passage of an axle 941 of a gear 94. The electric motor 92 is installed on the main frame 90 by extending screws 93 through the holes 904 to engage with the threaded holes 921 of the electric motor 92. The axle 941 is kept in place by a packing 95 and a C-shaped retainer 96. The gear 94 is meshed with a pinion 922 on the output axle of the electric motor 92. The gear 94 is provided with an eccentric pin 942 engaged with an outer end of the piston rod 97. As the electric motor is turned on, the pinion 922 will drive the gear 94 to reciprocate the piston within the cylinder for supplying compressed air via an outlet pipe 98. The cylinder 91 is fixedly mounted on the horizontal portion of the main frame 90 by screws 99. However, the vibration produced during the operation of the cylinder 91 will loosen the screws 99 thereby making the piston unable to move smoothly within the cylinder 91. Sometimes, the piston will be even locked in a fixed position within the cylinder 91. In addition, such an air compressor can only be used with a particular kind of nozzle thus limiting its usage.

Therefore, it is an object of the present invention to provide an improved structure of an air compressor which can obviate and mitigate the above-mentioned drawbacks.

SUMMARY OF THE INVENTION

This invention is related to an improved air compressor.

It is the primary object of the present invention to provide an improved structure of an air compressor which can be operated steadily and smoothly.

It is another object of the present invention to provide an improved structure of an air compressor which has two outlet pipes adapted for use with different nozzles.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
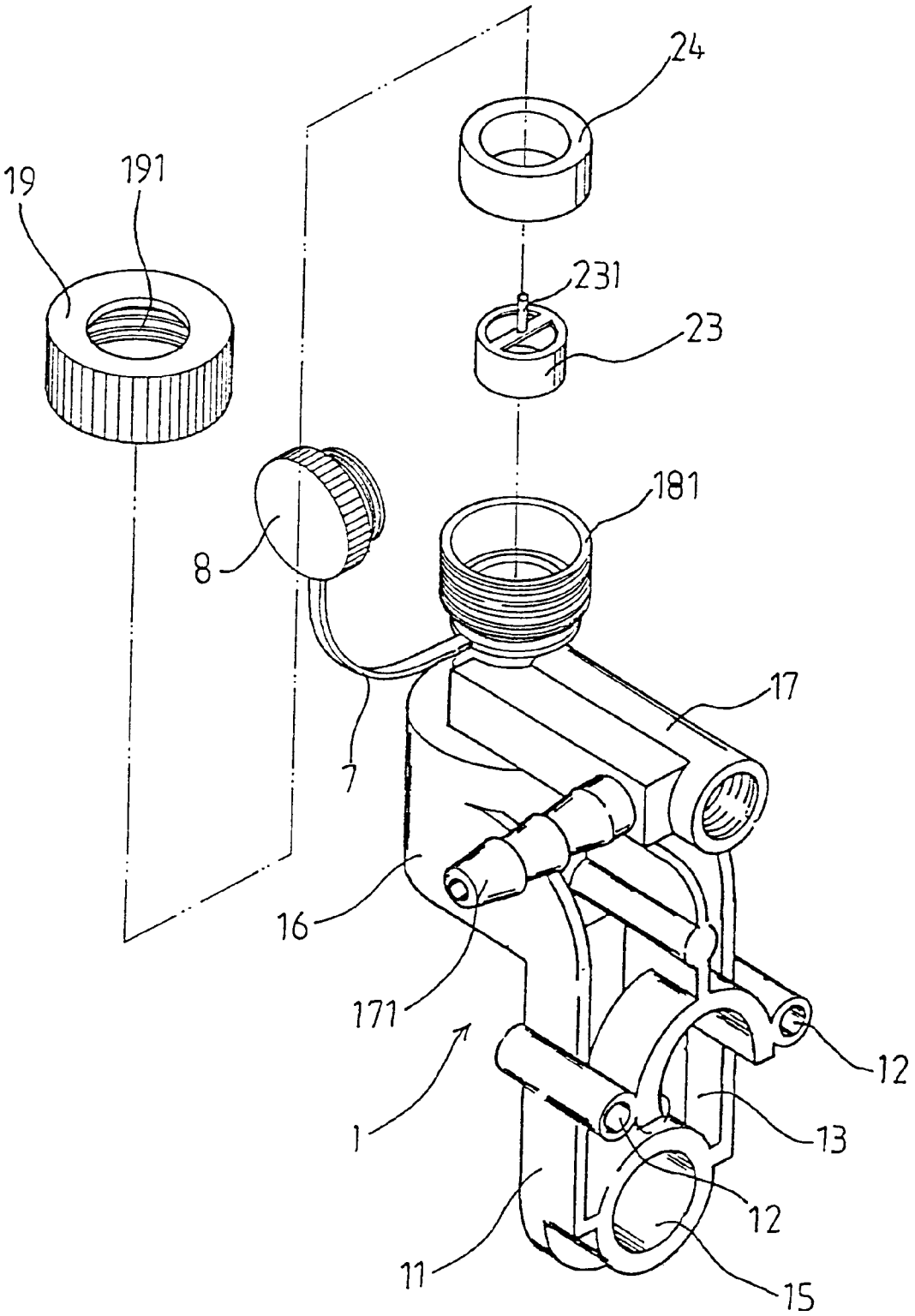
FIG. 1 is a perspective view of a main frame for an air compressor according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
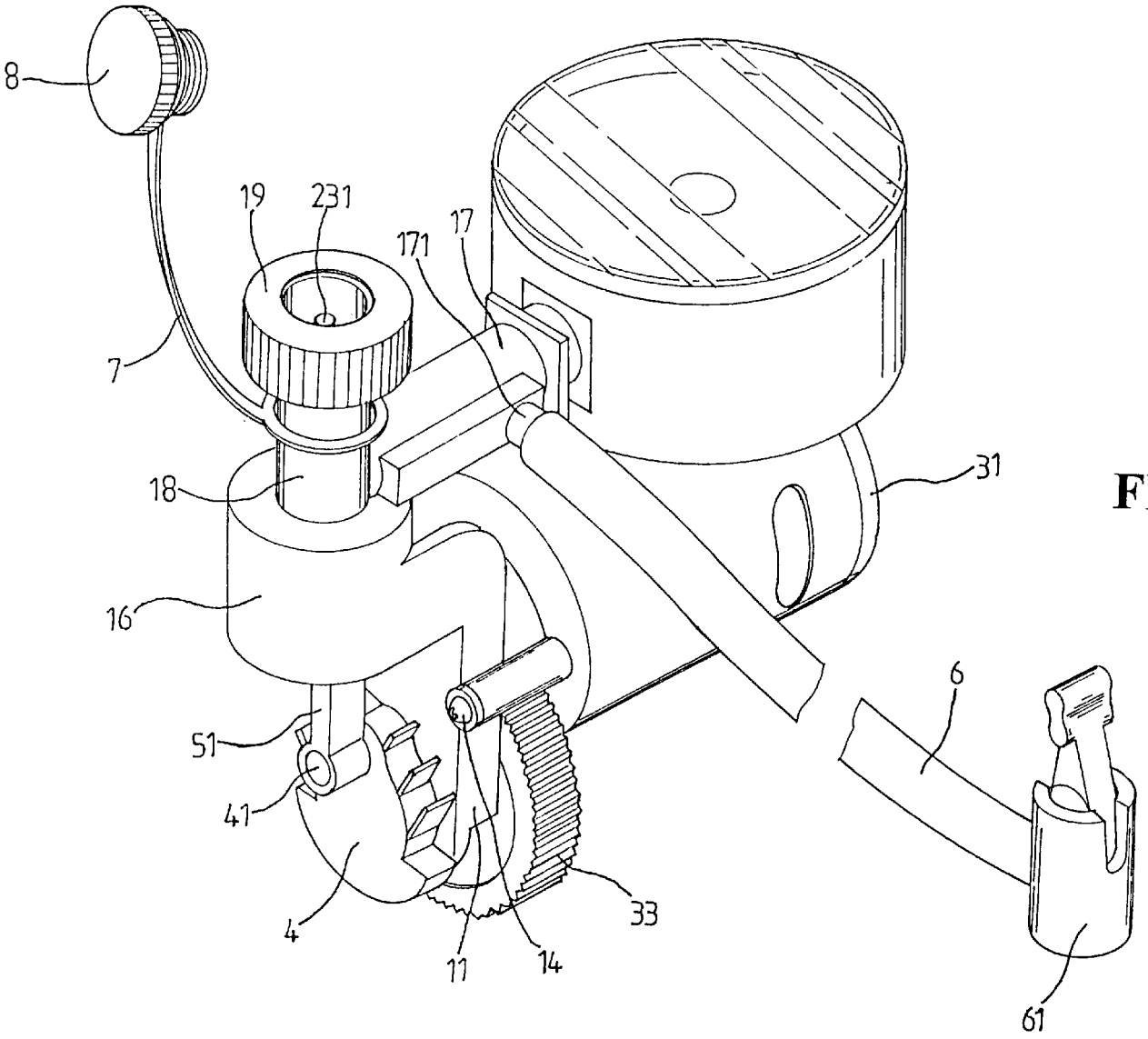
FIG. 2 is a perspective view of an air compressor according to the present invention.
Figure 3:
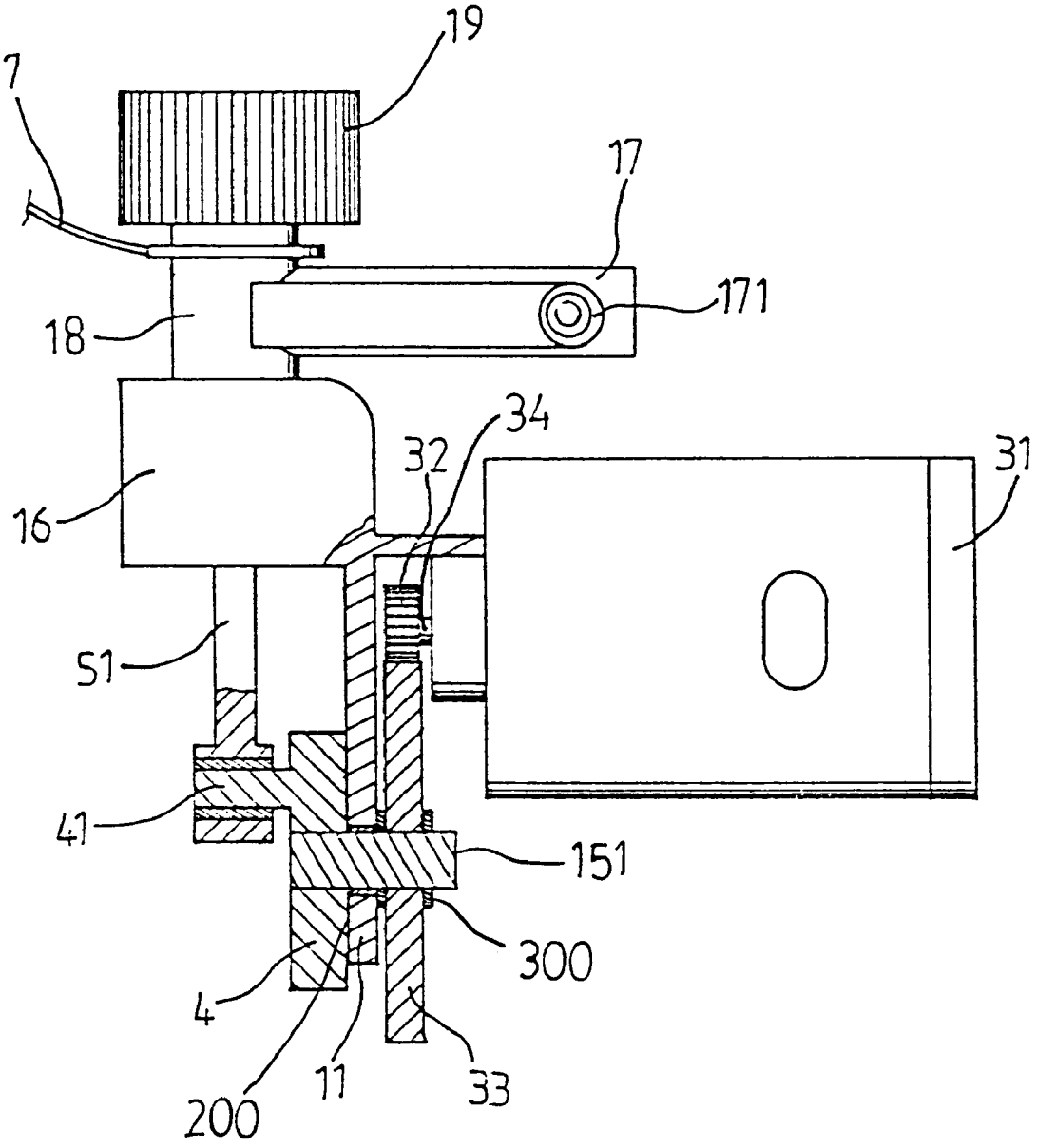
FIG. 3 is a sectional view of the air compressor according to the present invention.
Figure 6:
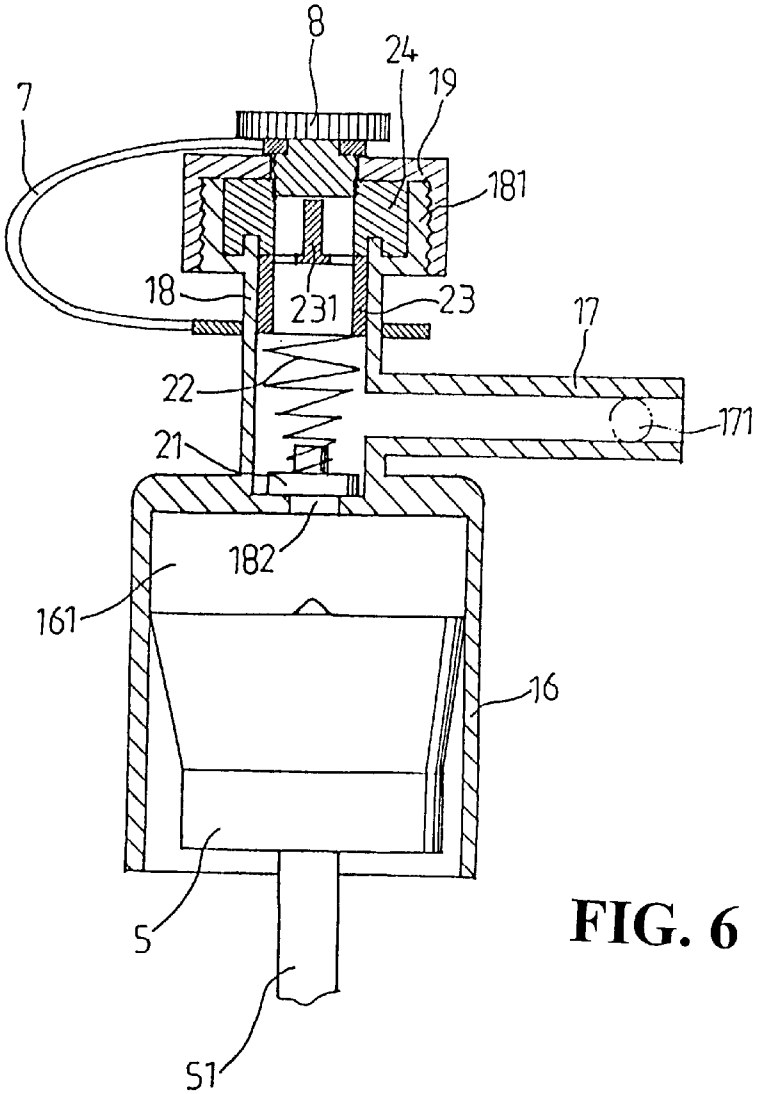
FIGS. 6, 7, 8 and 9 illustrate the working principle of the present invention.
Figure 7:
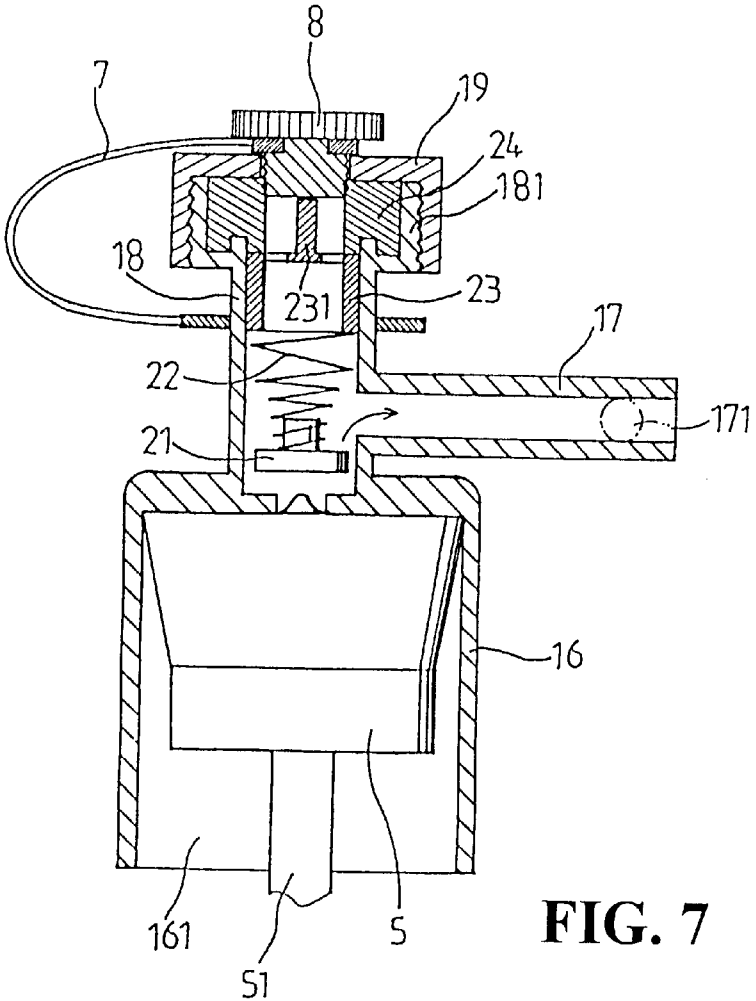

With reference to the drawings and in particular to FIGS. 1, 2 and 3 thereof, the air compressor according to the present invention comprises a one-piece injection molded main frame 1. The main frame 1 has a vertical portion 11 formed with two horizontal holes 12, an upper opening 13 between the two horizontal holes 12, and a lower circular opening 15 below the upper opening 13. Two screws 14 extend through the two horizontal holes 12 to fixedly mount an electric motor 31 on the vertical portion 11 of the main frame 1. The electric motor 31 has an output axle 34 extending through the opening 13 of the vertical portion 11 to engage with a driving gear 32 (see FIG. 3). A shaft 151 is rotatably fitted in the lower opening 15 of thevertical portion 11 and kept in place by a retainer ring 300. A bushing 200 is fitted within the lower opening 15 for protecting the shaft 151. A driven gear 33 is fixedly mounted on the shaft 151 and meshed with the driving gear 32. A flywheel 4 formed with an eccentric projection 41 is fixedly mounted on the shaft 151 and located adjacent to one side of the driven gear 33 (see FIG. 3). The upper part of the vertical portion 11 is formed with a cylinder 16 having a cylindrical chamber 161 in which is fitted a piston 5 (see FIGS. 6 and 7). The center line of the cylinder 16 is parallel to that of the vertical portion 11. The piston 5 is provided with a piston rod 51 extending downwardly out of the cylinder 16 to engage with the eccentric projection 41 of the flywheel 4 (see FIG. 3). Two outlet pipes 17 and 18 are formed on the top of the cylinder 16. The outlet pipe 17 is provided with a connector 171 (see FIG. 1) for connecting with an end of a flexible pipe 6 (see FIG. 2). The other end of the flexible pipe 6 is provided with a nozzle 61. The outlet pipe 18 is formed at the upper end with external threads 181 adapted to engaged with a cap 19. The cap 19 is formed with a hole 191 at the central portion (see FIG. 1). The outlet pipe 18 has a neck portion under the external threads 181 and the neck portion is connected with an end of a rubber strap 7. The other end of the rubber strap 7 is connected to a cover 8. The lower end of the outlet pipe 18 is formed with an orifice 182 in communication with the upper end of the chamber 161 of the cylinder 16. A plug 21 is arranged on the orifice 182. A spring 22 is mounted within the outlet pipe 18, with its lower end bearing against the plug 21. A sleeve 23 having an upwardly extending projection 231 is fitted within the outlet pipe 18. The lower end of the sleeve 23 bears against another end of the spring 22. A rubber packing 24 is arranged between the sleeve 23 and the cap 19.

Figure 5:
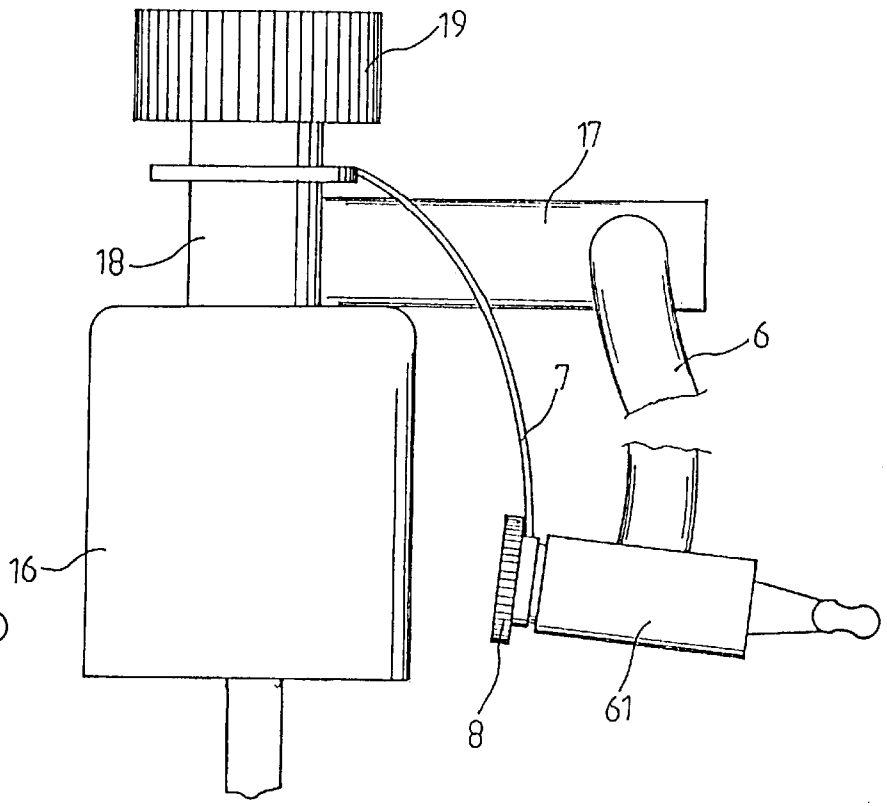
FIG. 5 illustrates how to use the cover to another one of the outlet pipes.
Figure 4:
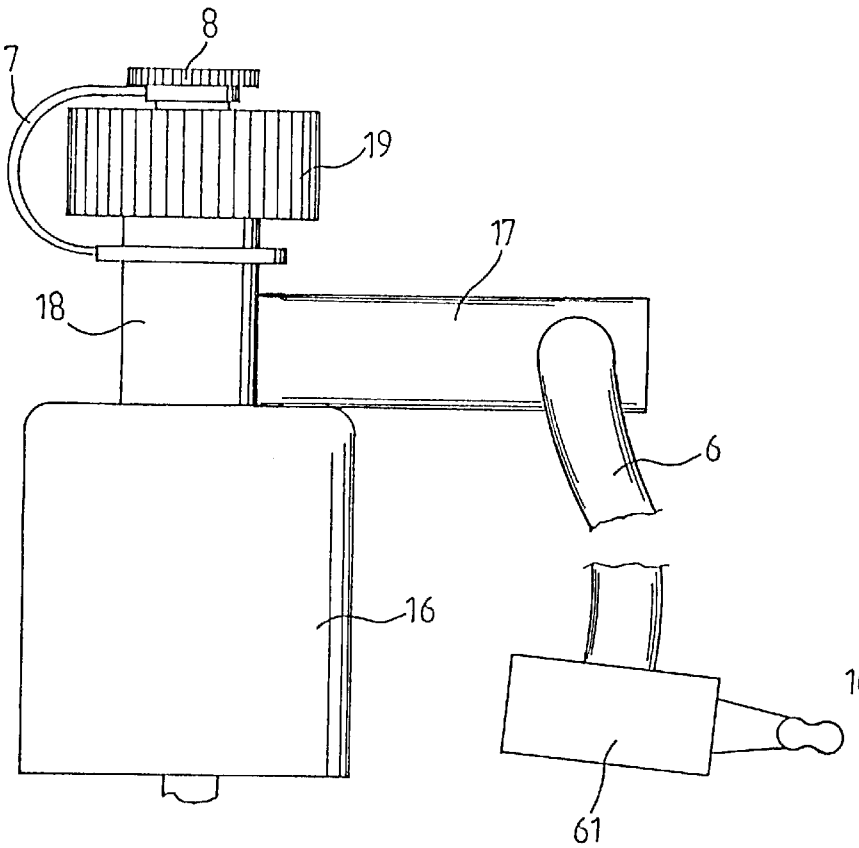
FIG. 4 illustrates how to use the cover to engage with one of the outlet pipes.
Figure 8:
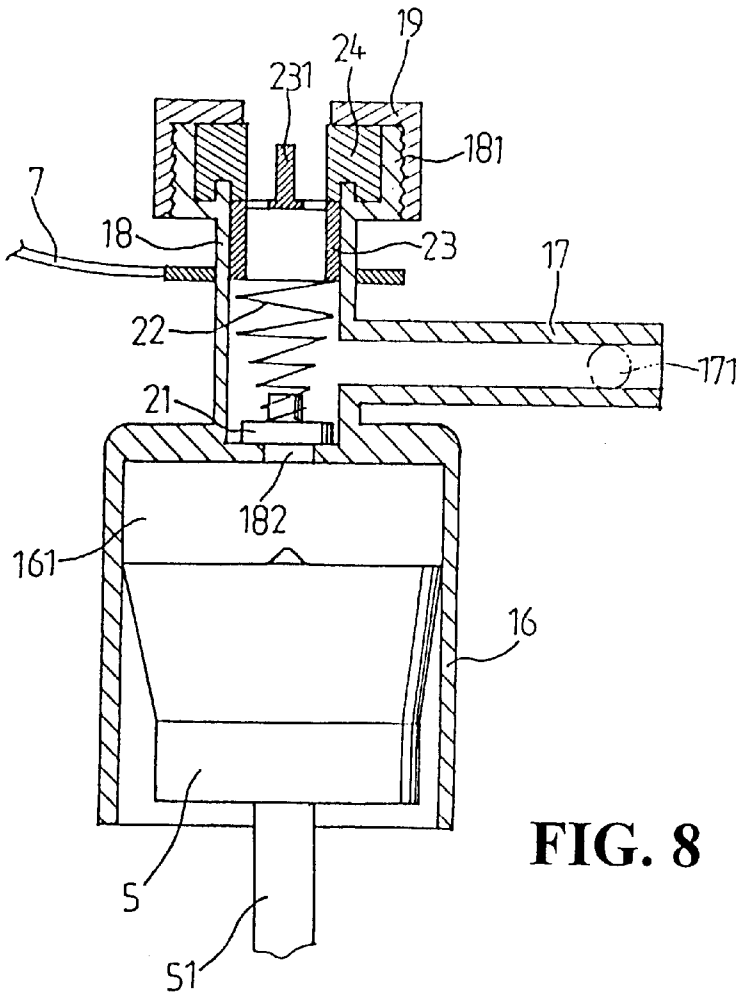
Figure 9:
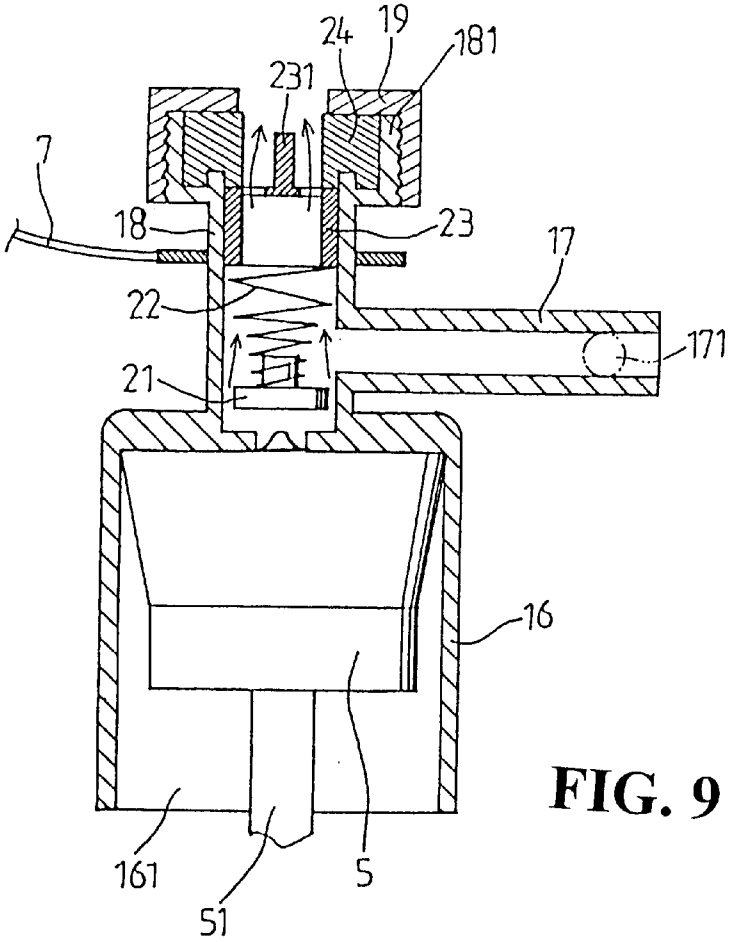
Figure 10:
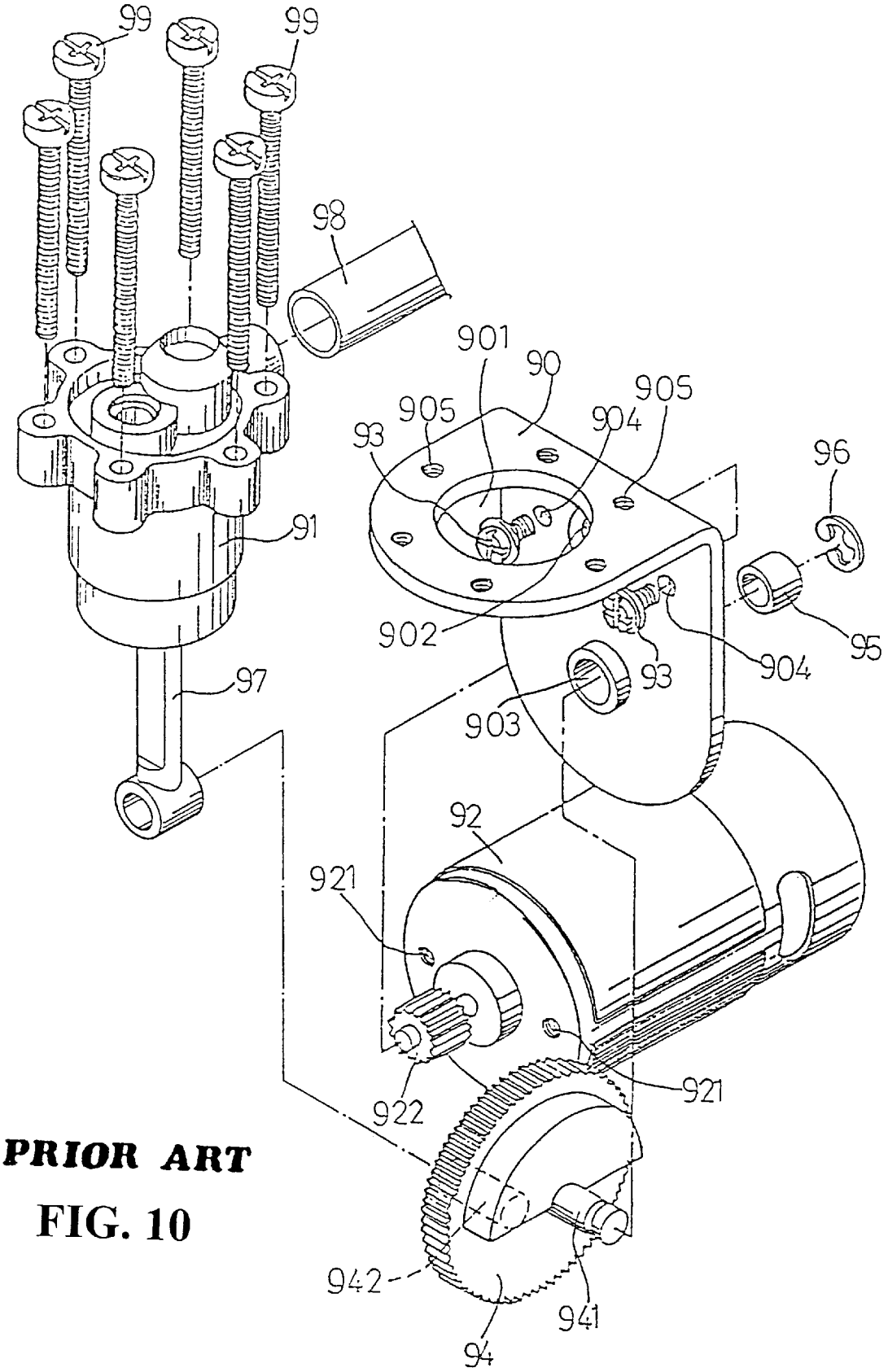
PRIOR ART FIG. 10
FIG. 10 is an exploded view of a prior art air compressor.

The outlet pipes 17 and 18 are designed for use with different nozzles and can be selectively used as required. When desired to use the outlet pipe 17, the cover 8 is pluged into the upper end of the outlet pipe 18 (see FIG. 4) and air will be forced out of the outlet pipe 17 by the piston 5 (see FIGS. 6 and 7). Similarly, when desired to use the outlet pipe 18, the cover 8 is pluged into the nozzle 61 of the outlet pipe 17 (shown in FIG. 5) and air will be forced out of the outlet pipe 18 (see FIGS. 8 and 9). The cap 19 may be adjusted so that the projection 231 of the sleeve 23 can be forced to push open the valve (not shown) of an object to be inflated.

As the electronic motor 31 is turned on, the driving gear 32 will drive the driven gear 33 and flywheel 34 thereby reciprocating the piston 5 within the cylinder 6 thereby compressing air.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An air compressor comprising: a one-piece injection molded main frame including a vertical portion formed with two horizontal holes, an upper opening between said two horizontal holes and a lower circular opening below said upper circular opening, two screws extending through said two horizontal holes to fixedly mount an electric motor on said vertical portion of said main frame, said electric motor having an output axle extending through said circular opening of said vertical portion to engage with a driving gear, a shaft rotatably fitted in a lower circular opening and kept in place by a retainer ring, a bushing fitted in said lower circular opening, a driven gear fixedly mounted on said shaft and meshed with said driving gear, a flywheel formed with an eccentric projection fixedly mounted on said shaft and located adjacent to said driven gear, an upper part of said vertical portion being formed with a cylinder in which is fitted a piston, said cylinder having a center line parallel to said vertical portion, said piston being provided with a piston rod extending downwardly out of said cylinder to engage with said eccentric projection, a first and second outlet pipes formed on the top of said cylinder, said first outlet pipe being provided with a connector for connecting with an end of a flexible pipe, another end of said flexible pipe being provided with a nozzle, said second outlet pipe having an upper end formed with external threads engaged with a cap, said cap being formed with a center hole, said second outlet pipe having a neck portion under said external threads, and a cover engageable with said center hole of said cap and said nozzle, a lower end of said second outlet pipe being formed with an orifice in communication with an upper end of said cylinder, a plug arranged on said orifice, a spring mounted within said second outlet pipe and having a lower end bearing against said plug, a sleeve having an upwardly extending projection fitted within said second outlet pipe, a lower end of said sleeve bearing against another end of said spring, and a rubber packing arranged between said sleeve and said cap.

2. The air compressor as claimed in claim 1, further comprising a rubber strap having an end engaged with said neck portion and another end engaged with said cover.

* * * * *